US006659521B2

(12) United States Patent
Hill et al.

(10) Patent No.: US 6,659,521 B2
(45) Date of Patent: Dec. 9, 2003

(54) SUSPENSION CEILING CLIPS AND INSTALLATION METHOD

(75) Inventors: Thomas R. Hill, Flippin, AR (US); Hank Tiley, Mountain Home, AR (US); Wesley Due, Flippin, AR (US); Dennis Shrable, Flippin, AR (US); James Dilday, Flippin, AR (US)

(73) Assignee: Micro Plastics, Inc., Flippin, AR (US)

( * ) Notice: Subject to any disclaimer, the term of this patent is extended or adjusted under 35 U.S.C. 154(b) by 9 days.

(21) Appl. No.: 09/993,983

(22) Filed: Nov. 16, 2001

(65) Prior Publication Data

US 2003/0094821 A1 May 22, 2003

(51) Int. Cl.[7] ..... A47F 13/06

(52) U.S. Cl. ..... 294/19.1; 248/228.7; 248/231.81; 248/340

(58) Field of Search ..... 294/19.1, 22, 24; 248/222.12, 229.26, 227.4, 228.1–228.7, 231.81, 320, 322, 339, 340; 24/457

(56) References Cited

U.S. PATENT DOCUMENTS

| | | | | |
|---|---|---|---|---|
| 3,327,376 A | * | 6/1967 | Freeman et al. | 29/225 |
| 3,463,432 A | | 8/1969 | Ptak | |
| 3,561,718 A | | 2/1971 | Iverson | |
| 3,743,228 A | | 7/1973 | Drab | |
| 3,936,913 A | | 2/1976 | Weissman | |
| 3,952,985 A | | 4/1976 | Davenport | |
| 4,041,668 A | | 8/1977 | Jahn et al. | |
| 4,065,090 A | | 12/1977 | Mauney | |
| 4,073,458 A | | 2/1978 | Sease | |
| 4,112,550 A | | 9/1978 | DeWitt | |
| 4,135,692 A | | 1/1979 | Ferguson | |
| 4,221,355 A | | 9/1980 | Hoop | |
| 4,223,488 A | | 9/1980 | Schoenung | |
| 4,315,611 A | | 2/1982 | Hoop | |
| 4,323,215 A | | 4/1982 | Berger | |
| D289,251 S | | 4/1987 | Joseph | |
| D321,639 S | * | 11/1991 | Adams | D8/373 |
| 5,188,332 A | | 2/1993 | Callas | |
| 5,247,725 A | | 9/1993 | Vaughn, Jr. | |
| 5,267,764 A | | 12/1993 | Hoffman | |
| D364,799 S | | 12/1995 | Callas | |
| 5,490,651 A | | 2/1996 | Kump | |
| 5,632,519 A | | 5/1997 | Stock | |
| 5,806,823 A | | 9/1998 | Callas | |
| 5,938,255 A | | 8/1999 | Rose et al. | |
| 6,027,091 A | | 2/2000 | Johnson | |
| 6,048,010 A | | 4/2000 | Stocker | |

* cited by examiner

*Primary Examiner*—Dean J. Kramer
(74) *Attorney, Agent, or Firm*—Stephen D. Carver

(57) ABSTRACT

A system for hanging objects from conventional suspended ceilings comprises resilient clips snap-fitted to ceiling rails, an installation tool for controlling the clips, and an elongated pole that threadably couples to the tool, enabling clip manipulation. Each clip comprises an upper clasp, an integral, lower hook, and a midportion. Clasp jaws that yieldably deflect apart comprise opposed flanges that forcibly grip the ceiling rails. The installation tool comprises receptacles for temporarily receiving the clips, and an internal, threaded bore mated to the installation pole. Each receptacle comprises a pair of generally planar retaining arms that partially block a captivation slot. The midportions of the clips slidably fit within the installation tool captivation slots. When pushed towards the ceiling rails the jaws snap apart and surmount the horizontal rail portion. When released, the jaws retract, with their flanges firmly gripping the rail.

9 Claims, 20 Drawing Sheets

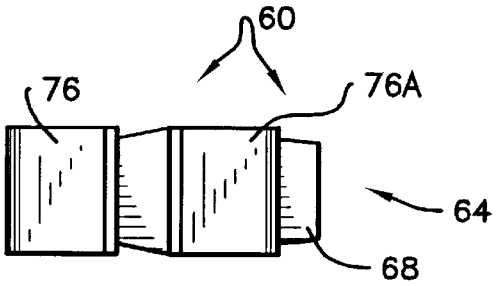
Fig. 8
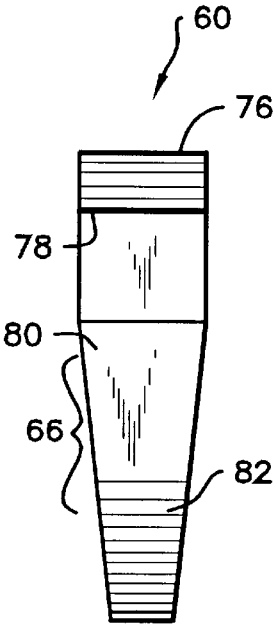
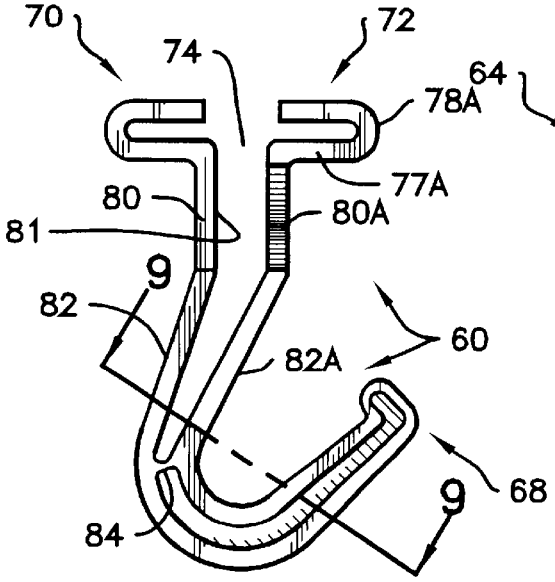
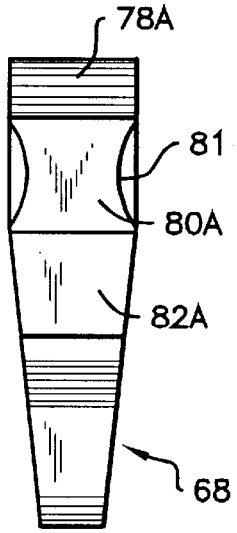
Fig. 5
Fig. 6
Fig. 4
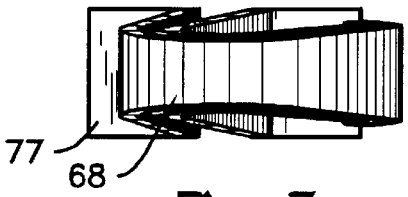
Fig. 7

SUSPENSION CEILING CLIPS AND INSTALLATION METHOD

BACKGROUND OF THE INVENTION

I. Field of the Invention

The present invention relates generally to clips and hanger devices for attachment to suspended ceilings. More particularly, the present invention relates to resilient, plastic clips designed to be snap-fitted to suspended ceiling rails for supporting miscellaneous objects, and it relates to a method and apparatus for installing such clips. Pertinent prior art clips germane to the invention can be found in United States Patent Class 248, Subclasses 228.1, 228.3, 228.4, 228.7, 317, 318, 339 and 340.

II. Description of the Prior Art

Suspended ceilings are in widespread use, particularly in commercial environments including retail stores, business offices and the like. Typical suspended ceilings comprise an elevated array of grid-like, metal support rails that are suspended from adjacent ceiling structure. Typical ceiling support rails have an inverted, "T-shaped" vertical cross section. They comprise a planar, perpendicular portion disposed vertically with respect to ground, and an integral, horizontal flange portion forming the bottom. Typical suspended ceilings comprise multiple panels or ceiling tiles that are captivated between and supported upon the adjacent, spaced apart rails forming the superstructure. Some of the tiles or ceiling panels may mount various air-conditioning vents or louvers. Usually a plurality of light fixtures also supported by the rails are interspersed between various tiles. The tiles and light fixtures rest upon the horizontal "flanges" on the supporting rails, and they are horizontally restrained by abutment with the integral vertical portions. The mutually orthogonal edges of the spaced apart support rails form a regular, grid-like pattern, visually dividing the suspended ceiling into a plurality of rectangles or squares.

In many retail sales establishments, such as discount stores, grocery stores and the like, it is advantageous to prominently display various signs, flags, banners, advertisements, markers, placards, or the like. Frequently, diverse ornamental or utilitarian items such as toys, novelty displays, mobiles, stuffed animals, or Christmas decorations are also mounted to the ceiling structure for maximum visibility. In addition, flower pots or baskets are commonly suspended for aesthetic purposes. Items that are mounted as high as possible are more likely to be readily observed by customers. Obviously, mounting from the ceiling maximizes potential visibility. Another advantage with ceiling mounting is that the suspended item is positioned out-of-the way, and inadvertent or unwanted physical human contact is avoided.

A variety of hanging devices have been previously proposed for suspending various items from ceiling structures. Items are typically suspended from ceilings with easily releasable fasteners using magnets or quick-installing clips. Typical prior art clips usually comprise some form of jaw structure or engaging the horizontal flange portion of the metal rails.

For example, U.S. Pat. No. 3,743,228, comprises a hanger clip for suspended ceilings that has a pair of spring biased jaws. The jaws are normally biased together by a coiled spring. Each jaw has a horizontal portion that grasps the ceiling rail, and when manually deflected apart they can be forced into a captivating position to attach themselves to a rail. Various items may thus be hung from a ceiling with the clip. However, manual installation and removal are required, usually with the use of ladder. This can be time-consuming and dangerous for the workman. In addition, this clip comprises several working parts that complicate the design and increase its cost.

U.S. Pat. No. 6,027,091 comprises an integral, extruded clip that similarly comprises a pair of oppositely disposed, jaw-like channels. Installation is preceded by manually compressing the clip, to leverage the channels apart. Upon release, they retract to grab and thus captivate the ceiling rail flange.

U.S. Pat. No. 4,223,488 discloses a metal hanger with an integral, U-shaped end portion that initially grabs a portion of the ceiling rail. A separate retaining clip is required for completing installation. The clip fastens to the opposite side of the hanger, in engagement with the exposed edge of the ceiling rail.

U.S. Pat. No. 4,221,355 discloses a metal clip with a central body forming a center. A pair of integral flanges are radially spaced-apart relative to the center. The flanges are adapted to be rotated into a grasping position, whereby edge portions of a suspended ceiling rail are captivated by the clip flanges. The design necessitates a number of separate fasteners.

U.S. Pat. No. 4,323,215 provides a clip that is functionally similar to that described in U.S. Pat. No. 4,221,355 discussed above. A pair of radially spaced-apart flanges on opposite edges of the clip body are rotated into a captivating, gripping position upon installation.

U.S. Pat. No. 4,315,611 comprises a ceiling hanger with a central metal plate equipped with integral, cooperating flanges. The spaced-apart flanges snap into engagement across the ceiling rail.

U.S. Pat. No. 4,065,090 shows a resilient plastic clip that may be snap-fitted to a rail. The resilient walls of the generally V-shaped structure are deformable. They are integral with an apertured body from which a variety of items may be suspended.

U.S. Pat. No. 3,952,985 comprises a metallic hanger clip having a single edge portion that is frictionally forced into contact with the horizontal flange of a ceiling rail. An integral bent portion of the clip stabilizes the arrangement by frictional contact with the exposed underside of the ceiling rail.

Other diverse clips of possible relevance are seen in U.S. Utility Pat. Nos. 3,463,432, 3,561,718, 3,936,913, 4,073,458, 4,041,668, 5,490,651, and 5,806,823. Design patents D289,251 and D364,799 also disclose analogous ceiling attachment clips.

Prior art ceiling clips are deficient for several reasons. Prior art metal versions comprising compound parts are simply too expensive. Many clips fail to adequately grasp the ceiling rail. Some ceiling clips can twist or drop off if item being supported by the clip is bumped or twisted. Many clips are difficult to install, and some require special tools. In addition, it is often difficult and time-consuming to install or remove known suspended ceiling clips. Installation difficulties are further compounded when installing clips in congested areas.

Installation often requires the use of ladders, scaffolding, or power lifts that can elevate at least one workman into an accessible position. Successful, timely installation projects often requires several workmen. Often stepladders or ladders have to be used while one person holds the sign and the other person attaches wires or hangers to an overhead support. Also, to avoid customers inconvenience, signs or displays are often installed or removed when the store is closed for business, thereby increasing labor costs. Not surprisingly, hand tools with elongated handles that facilitate installation from the ground or floor have previously been developed.

For example, U.S. Pat. No. 5,247,725 discloses an elongated, pliers-like tool that can compress and elevate a ceiling clip for installation. The handles may be compressed manually, or a draw string may be deployed in hard-to-reach situations.

U.S. Pat. No. 5,632,519 discloses a retractable pole for attaching items to previously-installed ceiling clips. It can be telescoped between elongated deployed positions and retracted, storage orientations.

Similar elongated tools for mounting ceiling clips or items to be suspend from such clips are seen in U.S. Pat. Nos. 4,135,692, 5,052,733, 5,188,332, 5,267,764, 5,938,255, 6,048,010.

Known installation tools have several disadvantages. Conventional tools are cumbersome and complex. They require substantial manual dexterity and hand-eye coordination. For example, the tool disclosed in U.S. Pat. No. 5,188,332 has pivoting jaws which require substantial force. This makes it difficult to grab or release an object at the same time the jaws are being operated. Further, prior art tools are often incomplete, in that the installer-user must have a set of hand tools in addition to the clip-installation tool for successful use and installation.

Thus a rapidly deployable clip that can be easily and safely installed from the ground by a single person would be highly desirable. Such a clip must be inexpensive and lightweight, and at the same time, strong and dependable. Further, would be advantageous to avoid complex metallic tools with compound parts. A resilient plastic clip that accomplishes these goals, and a apparatus and a method for installing such a clip are proposed.

SUMMARY OF THE INVENTION

Our invention comprises a unique system for hanging diverse objects from conventional suspended ceilings. Resilient, injection-molded plastic clips described herein are adapted to be snap-fitted to the conventional, exposed rails in a typical suspended ceiling. Installation is conveniently done from the ground, without ladders or lifting equipment. A new barrel-like installation tool releasably captivates our clips, and holds them in a convenient installation position. The barrel tool threadably couples to conventional wooden poles and handles with ACME threads, so the assembly can be easily elevated into position adjacent a ceiling rail. Once the hook to be installed is appropriately positioned, it may be snap-fitted to the rail by pushing the pole. When the hook engages the ceiling rail, the pole and the barrel tool may be conveniently withdrawn, and the clip slides out of the tool.

We have proposed a pair of clips, one of which is J-shaped, and the other of which is U-shaped. Each of our new clips comprises a resilient plastic body comprising an upper clasp, an integral, lower hook portion for hanging an item from the ceiling, and an integral, midportion connecting the clasp and the hook. Each hook comprises a pair of halves that are resiliently coupled together.

The hook clasps comprise a opposed jaws that may be yieldably deflected apart during installation. Each generally C-shaped jaw comprises opposed, upper flanges that forcibly grip the ceiling rails. When pushed towards the ceiling rails the jaws snap apart and surmount the horizontal rail portion. When released, the jaws retract, with their flanges firmly gripping the rail.

The clip midportions are specially configured to engage the barrel-like installation tool. The preferred installation tool comprises a generally cylindrical body resembling a barrel. A pair of special receptacles formed on the body. The body comprises an internal, threaded bore having ACME threads adapted to be mated to the installation pole. Each clip midportion comprises a flat, gradually narrowing, trapezoidal section that is adapted to be inserted within a special gap in the tool's special receptacles, that function as docking stations for removably receiving clips to be mounted. Each tool receptacle comprises a pair of generally planar retaining arms that face one another over a transverse captivation slot. The midportions of the clips slidably fit within the captivation slots to enable the barrel tool to remotely manipulate the clips when elevated by the installation pole.

A method of installing ceiling clips comprises the steps of providing resilient clips and barrel installation tools constructed as aforesaid. A suitable threaded pole is threadably coupled to the installation tool to provide access to the required height. The midportions of the clips are slidably mated to the installation tool's docking stations, being temporarily confined within the captivation slots. After clips to be installed are thereby temporarily secured to the mounting tool, the user may press the clips upwardly into engagement with the ceiling rails. When appropriately elevated and aligned, the assembly may be thrust towards the rails, and the clips snap-fit over the horizontal rail bottom. Afterwards the desired item or items to be hung are merely suspended from the clips.

Thus, our invention provides a unique solution for quickly hanging miscellaneous objects upon exposed ceiling support rails.

A basic object is to provide clips and an installation method and apparatus for quickly suspending miscellaneous objects from ceilings with said clips.

A related object is to provide resilient plastic clips that can be quickly attached to exposed suspended ceiling rails for hanging or mounting a variety of utilitarian and aesthetic items.

A similar object is to provide a simple, multi-piece clip assembly that is easily installed with minimal tools.

A related object is to provide resilient suspension ceiling clip that can be safely installed from the ground.

Another object of our invention is to provide a tool that enables a single person to install suspended ceiling clips of the character described.

Another object is to provide a safe method of attaching clips to ceilings or to suspended ceiling frame rails from the ground, without ladders, stools, lifting equipment, scaffolding or similar elevating structure.

Another simple object of the present invention is to provide a clip for installation upon a suspended ceiling rail, and a convenient, easily operated system for installing the clips.

A further object of our invention is to provide a manipulating tool of the character described that can be employed with common household or office poles bearing standard threads.

It is yet a further object of our invention to provide a ceiling clip installation tool system that may be readily operated by a single individual from a relatively safe position on the ground or floor.

Another important object is to avoid the requirement of complex special tools or equipment utilizing compound parts or heavy metal components.

Conversely, an important object is to provide a simple plastic tool for aiding in the installation of ceiling-mounted suspension clips.

A related object is to provide a clip for suspension ceiling mounting that is inexpensive.

A still further object of our invention is to provide a clip of the character described that is strong, lightweight, and dependable.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 4 is a side elevational view of the preferred clip;

FIG. 5 is a left end view of the preferred clip, taken from a position generally to the left of FIG. 4;

FIG. 6 is a right end view of the preferred clip, taken from a position generally to the right of FIG. 4;

FIG. 7 is a bottom plan view of the preferred clip, taken from a position generally beneath FIG. 4 and looking upwardly;

FIG. 8 is a top view of the preferred clip, taken from a position generally above FIG. 4 and looking downwardly;

DETAILED DESCRIPTION

Figure 1:
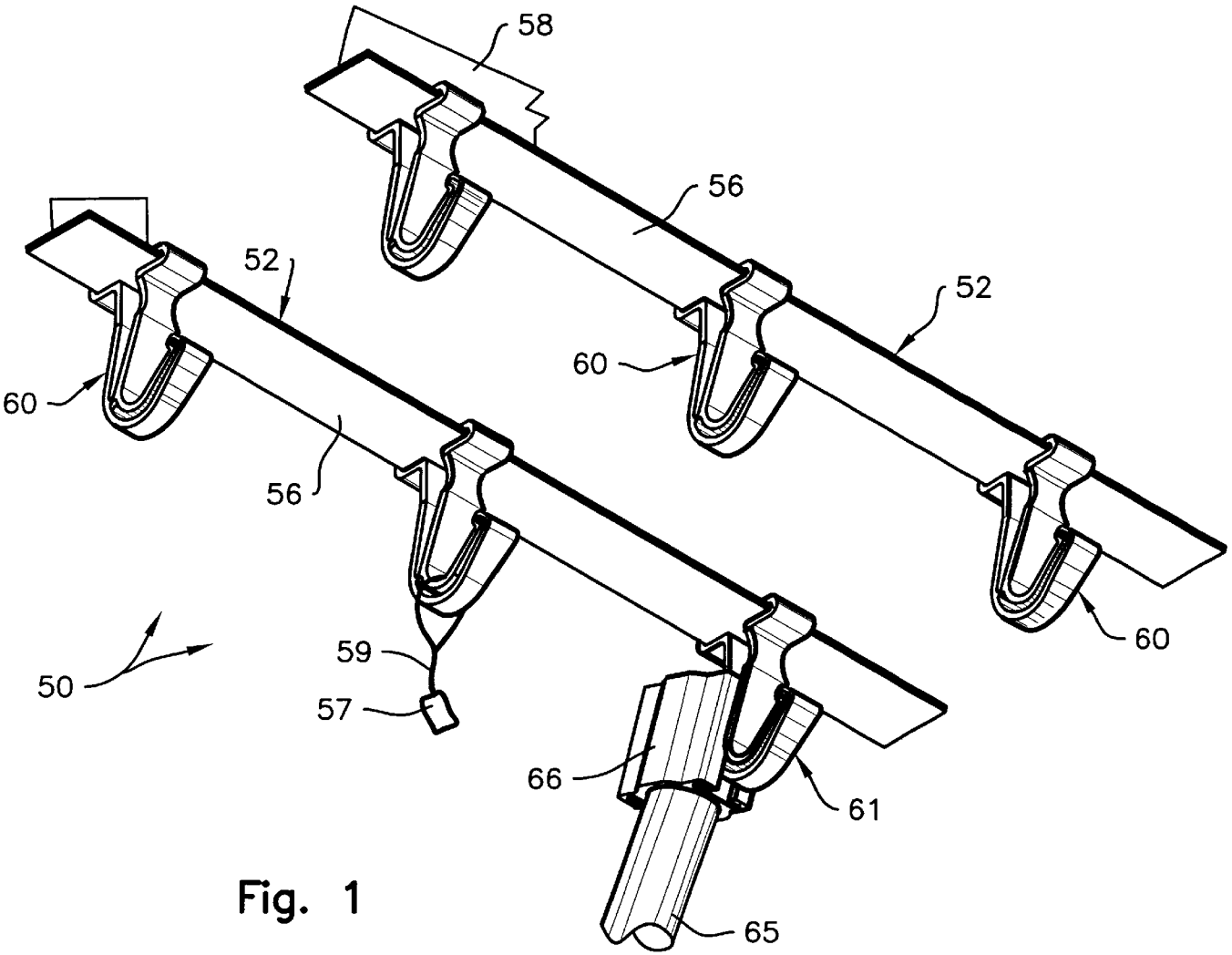
FIG. 1 is a fragmentary isometric view showing portions of a conventional suspended ceiling, showing a plurality of preferred clips installed upon the ceiling rails, and showing an installation tool and method for installation.
Figure 2:
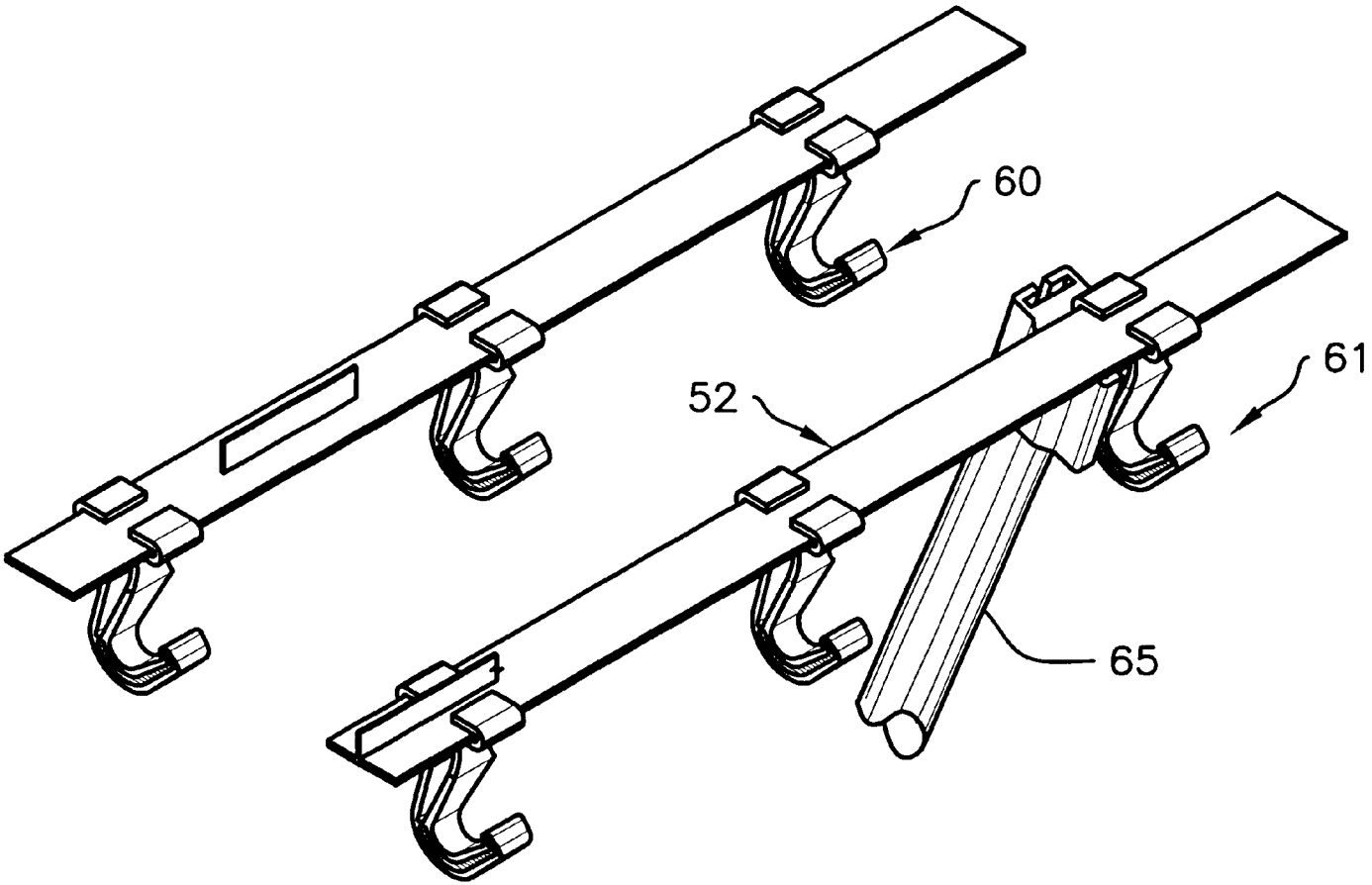
FIG. 2 is a fragmentary, isometric view of the underside of the suspended ceiling of FIG. 1.

Turning initially to FIGS. 1 and 2 of to the appended drawings, a suspended ceiling 50 is illustrated. The ceiling comprises a plurality of regularly spaced apart rails 52 that are arranged in orderly grids. As will be readily appreciated by those skilled in the art, the ceiling comprises an array or mutually orthogonal rails, including rails (not shown) that intersect rails 52 and divide the ceiling area into an orderly arrangement of regularly arranged rectangles. Typical rails 52 have a cross section generally in the form of an "inverted T," comprising a narrow and flat, horizontal bottom 56 and an integral, upwardly projecting vertical portion 58 (FIG. 2). Normally a plurality of ceiling tiles, not shown, will extend between and be supported by the rails 52, resting upon horizontal rail bottoms 56.

Several of our preferred clips, generally designated by the reference numeral 60, are shown in spaced apart relation mounted upon the rails 52. However, clip 61 (FIGS. 1, 2) is illustrated in an intermediate position being installed upon a ceiling rail. Clips are installed with the aid of a barrel-like installation tool 66, which is hand-manipulated by a user (not shown) with a conventional elongated, wooden pole 65. (An alternative installation tool is discussed later in conjunction with FIGS. 32–33). The barrel tool 66 is releasably, threadably engaged by pole 65, which can be manipulated from the floor or ground and functions as a temporary installation handle. Typical poles useable for this job may comprise handles for rakes or other garden or lawn implements, commode plunger poles, mop handles, paint-roller poles, or conventional threaded handles for brooms, mops or the like. Preferably, the barrel tool 66 has a standard ACME thread to match that used on many common poles. Once a clip 60 to be installed is fitted to the barrel tool 66, as hereinafter described in detail, the user may elevate the assembly into appropriate position proximate the suspended ceiling and then press-fit the clip onto the desired rail. By first aiming appropriately, and then gently pushing pole 65 to snap-fit the clip over the target rail, installation is readily insured.

Figure 29:
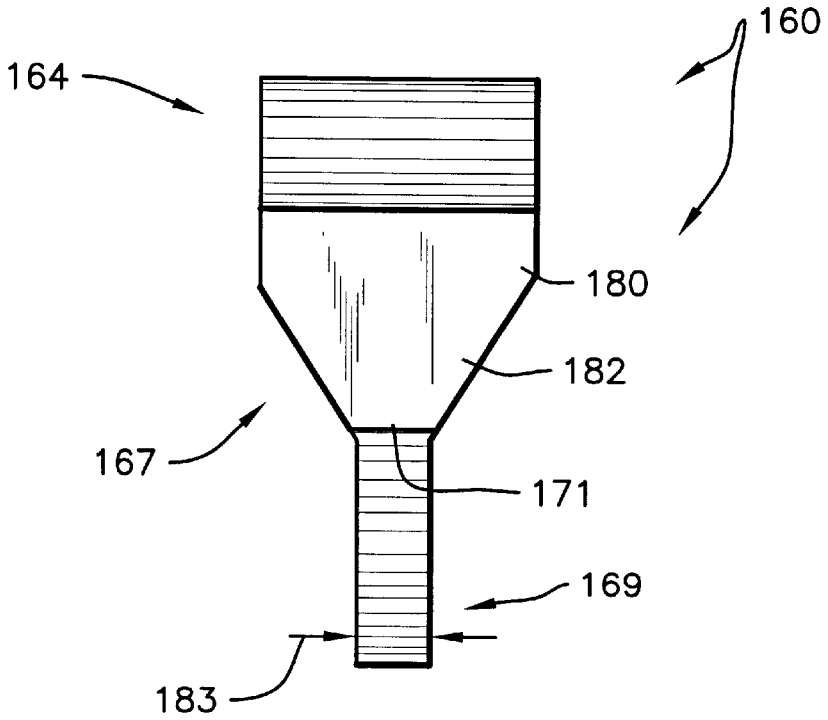
FIG. 29 is a left side elevational view of the alternative clip, taken from a position generally to the left of FIG. 28 and looking towards the right.
Figure 30:
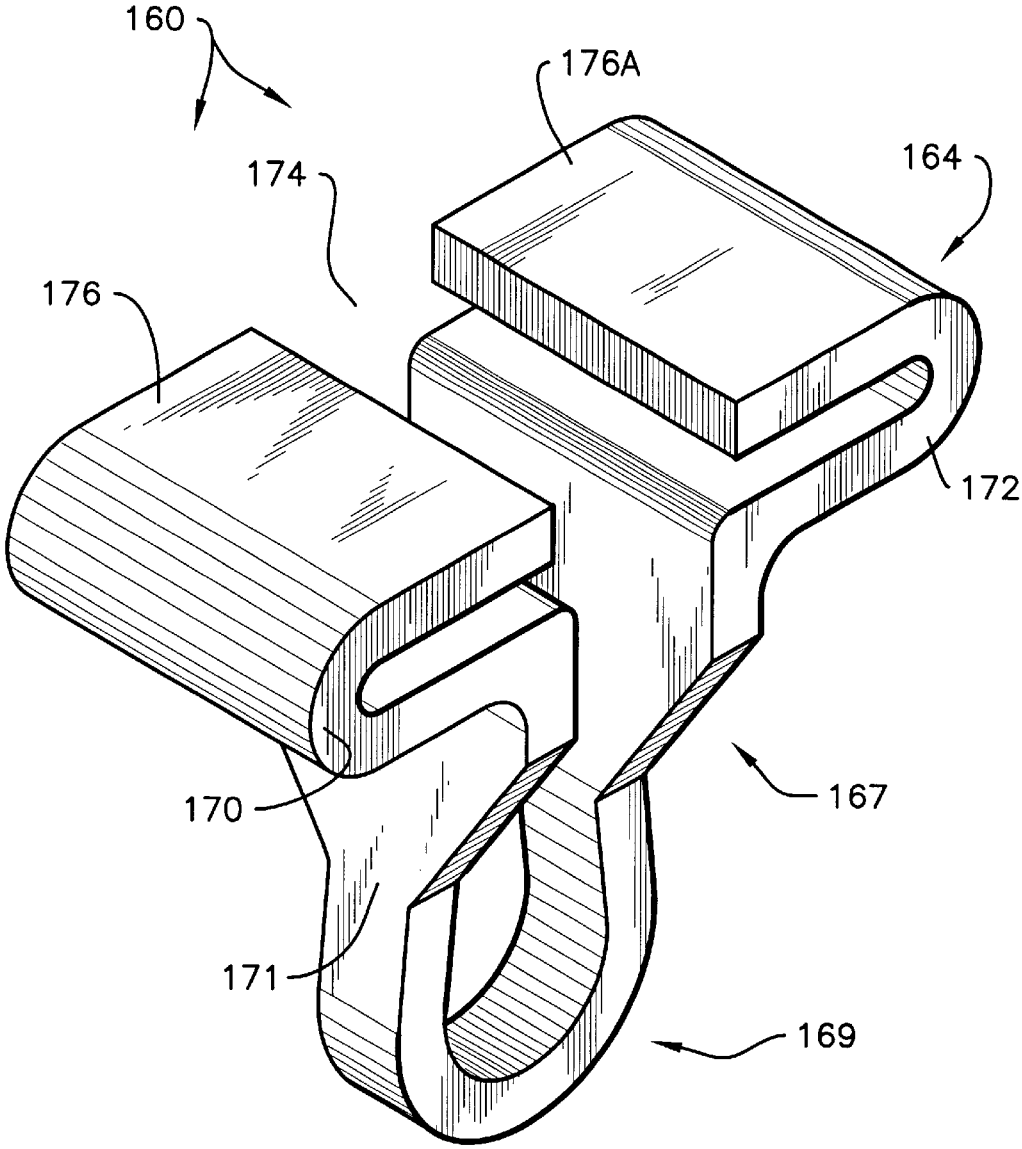
FIG. 30 is an enlarged isometric view of an alternative clip coupled to the preferred tool for subsequent installation.
Figure 31:
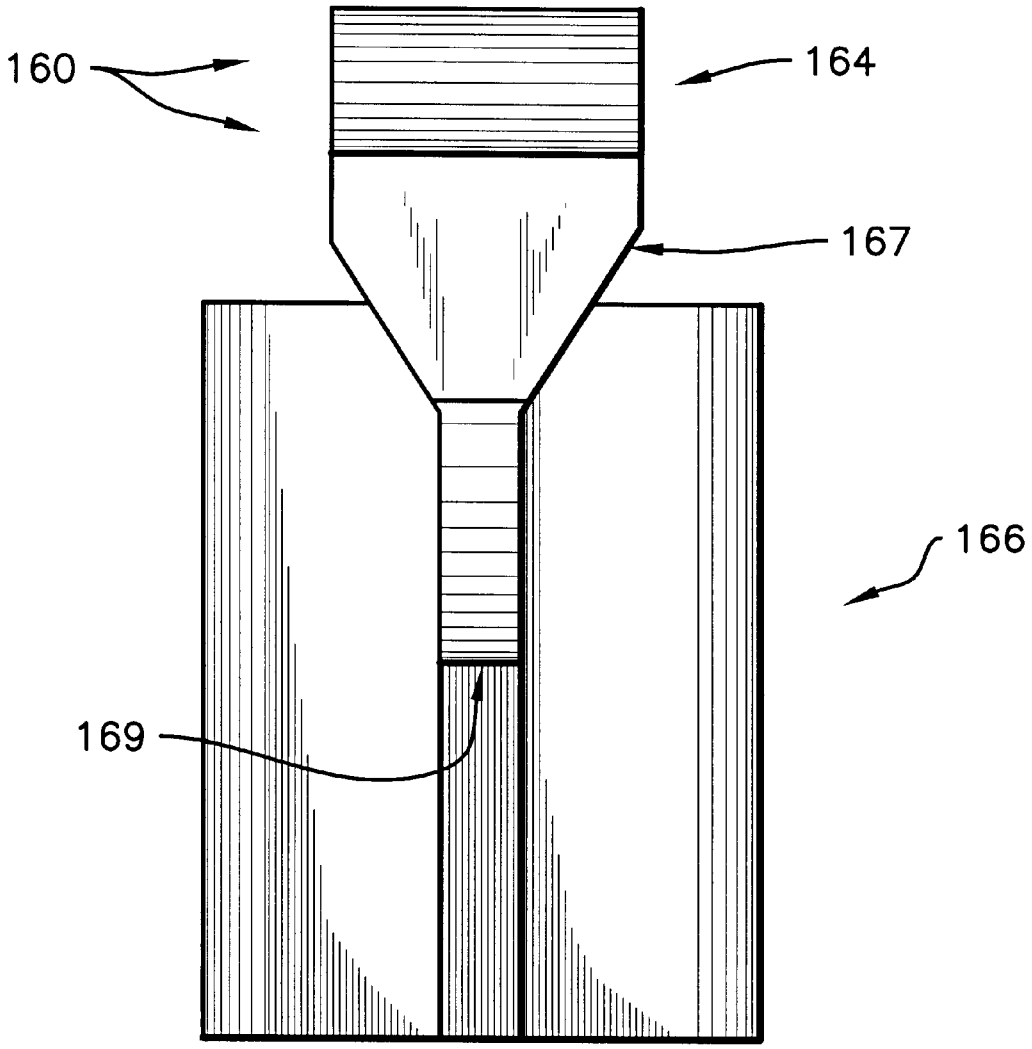
FIG. 31 enlarged, left side elevational view of the alternative clip, taken generally from a position to the left of FIG. 27.

With emphasis now directed concurrently to FIGS. 3–9, the preferred ceiling clip 60 is generally "J"-shaped. As detailed hereinafter, an alternative ceiling clip to be described hereinafter is generally "U"-shaped (i.e., FIGS. 28–30). Clip 60 is preferably injection molded from resilient plastic. Each clip comprises an upper clasp 64 adapted to be coupled to the ceiling rails, a lower portion in the form of a hook 68 that can support the item to be suspended, and an integral, intermediate midportion 67 connecting clasp 64 and hook 68. It will be appreciated that the clip comprises two very similar halves that are resiliently coupled together.

Clasp 64 comprises a pair of opposed jaws 70, 72 that face each other across a void 74. Each jaw 70, 72 is generally C-shaped in cross section, and with hook 68 they aesthetically contribute to the overall, generally J-shaped appearance of the clip 60. Jaws 70, 72 respectively comprise opposed, upper flanges 76, 76A that face each other across void 74. The gripping flanges 76, 76A on the top of each jaw are integral with lower, horizontal projections 77, 77A and the arcuate midsections 78, 78A. The jaws are adapted to grasp the rails of the suspended ceiling to mount the clips. They are displaced apart somewhat (as described in detail later) and then pushed into place surmounting the horizontal rail bottom 56 (FIG. 1). When released, the jaw flange portions 76, 76A contract and firmly grasp the rail.

The jaws are integral with the midportion 67, forming a ninety degree intersection therewith. Midportion 67 comprises a flat, intermediate panel 80 on the left side and a companion, spaced apart intermediate panel 80A that is curved slightly as indicated. Intermediate panels 80, 80A are of substantially uniform width and thickness, and they are respectively integrally joined with lower intermediate panels 82, 82A that are on non-uniform width (FIGS. 5, 6). Panels 82, 82A are thus shaped somewhat like trapezoids, with their width gradually and smoothly decreasing towards the lower hook 68. Preferably, an interior reinforcing web 84 (FIGS. 3, 4) integrally, transversely extends between panels 80, 82A at the juncture with hook 68. Panels 80 and 82 are converged as aforesaid so that they functionally fit to the barrel tool 66 during installation, as hereinafter described.

Figure 3:
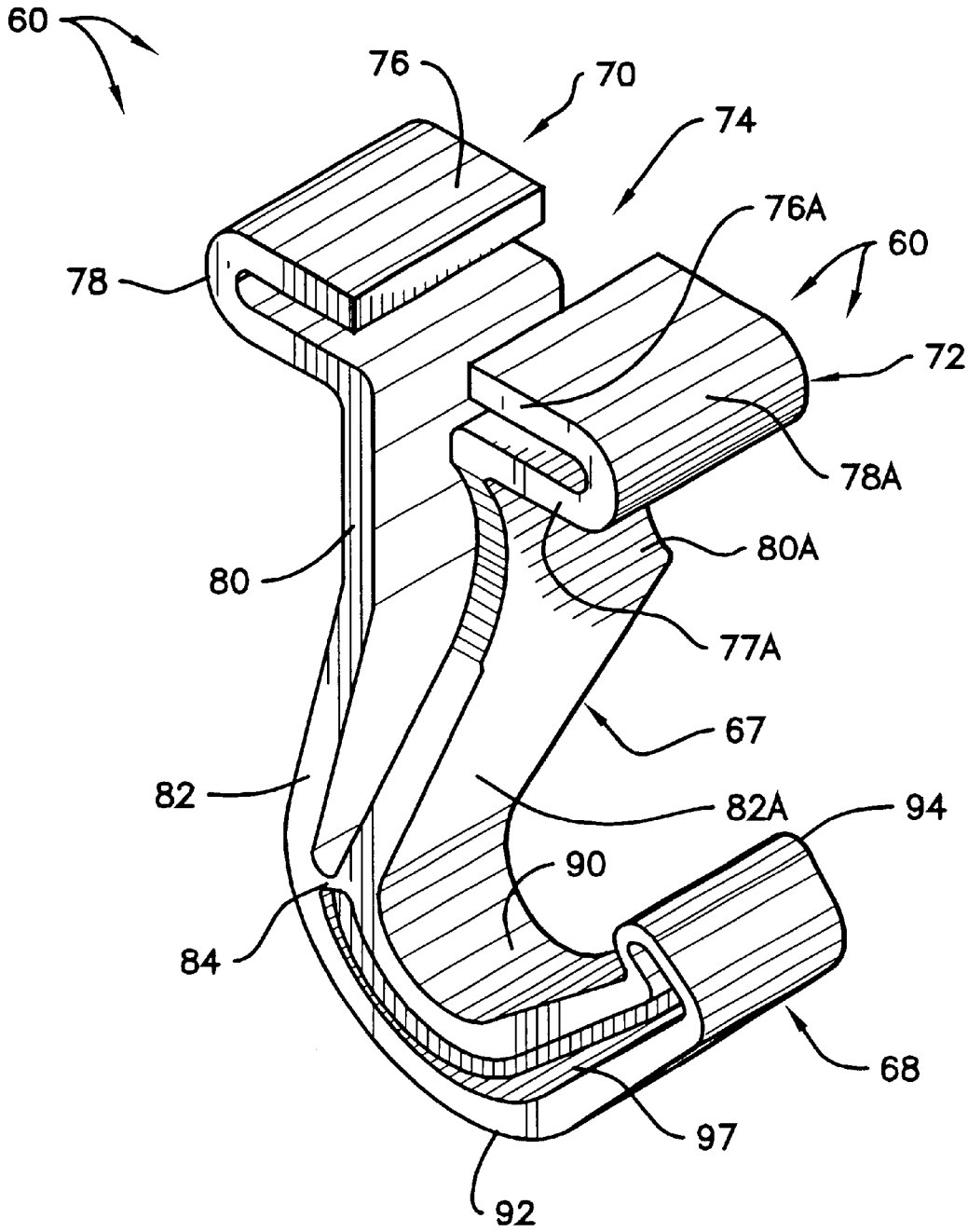
FIG. 3 is an enlarged isometric view of a preferred suspension clip constructed in accordance with the best mode of the invention.
Figure 9:
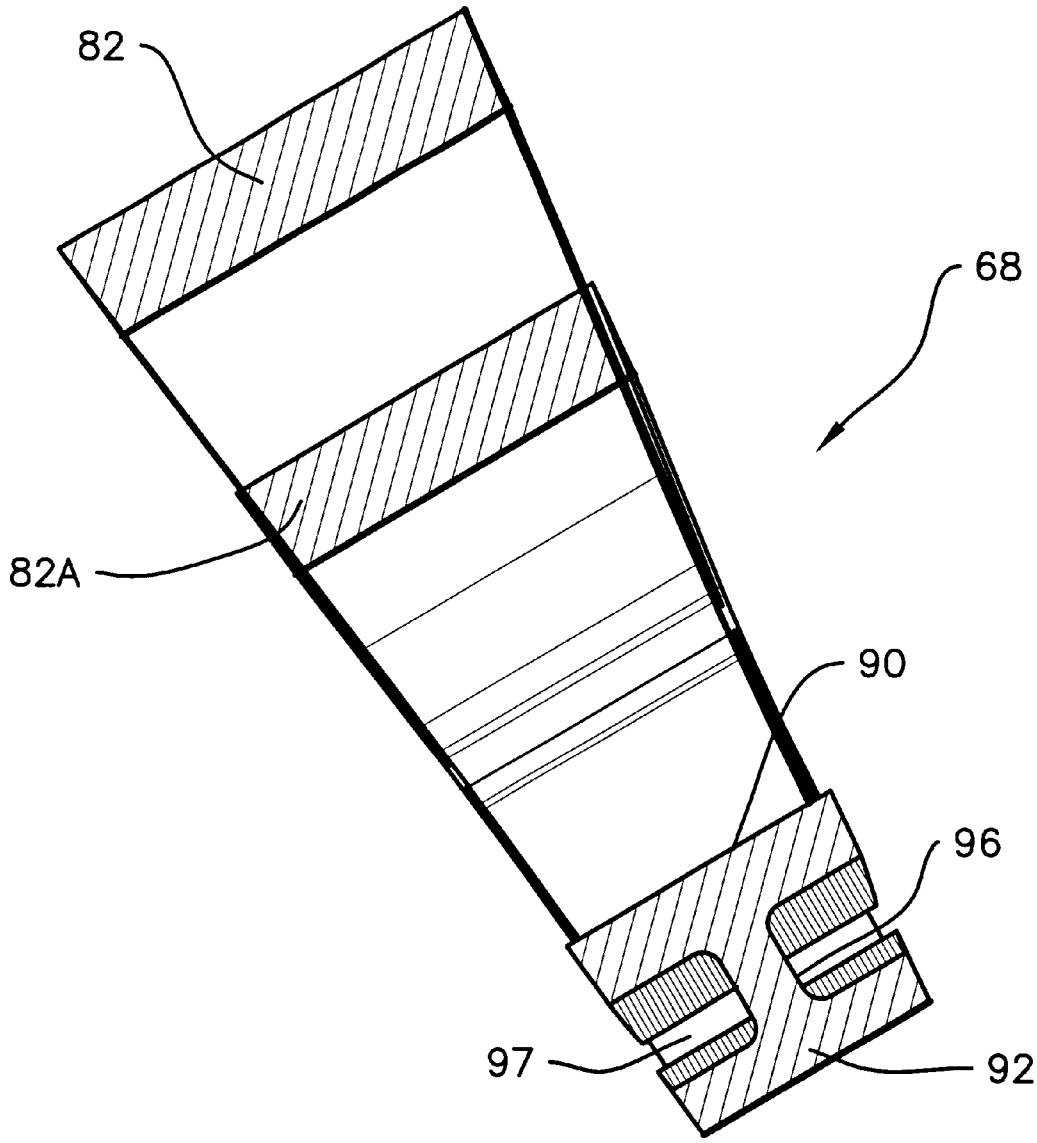
FIG. 9 is an enlarged sectional view taken generally along line 9—9 of FIG. 4.
Figure 10:
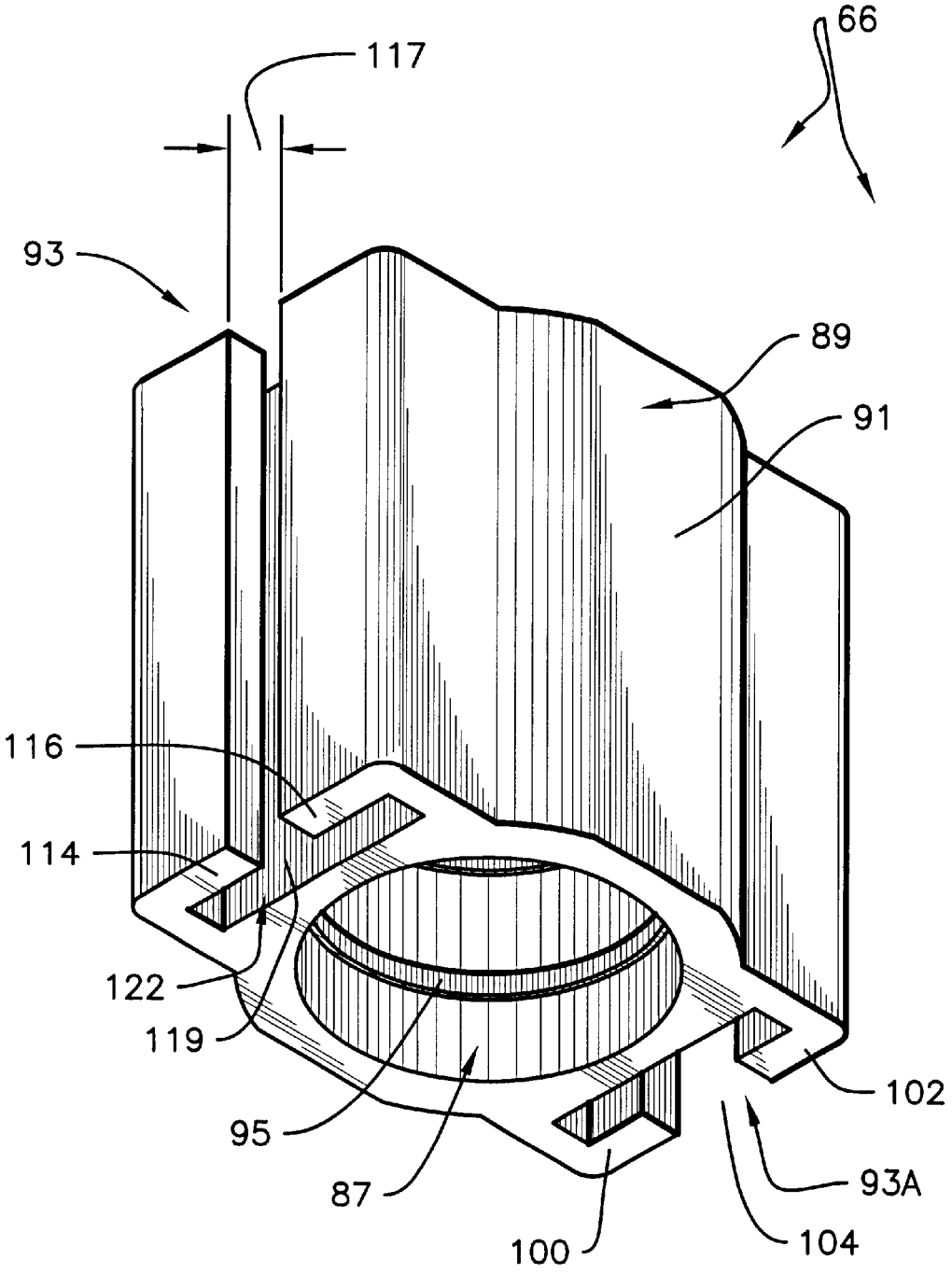
FIG. 10 is an enlarged, bottom isometric view of the ceiling clip installer.
Figure 23:
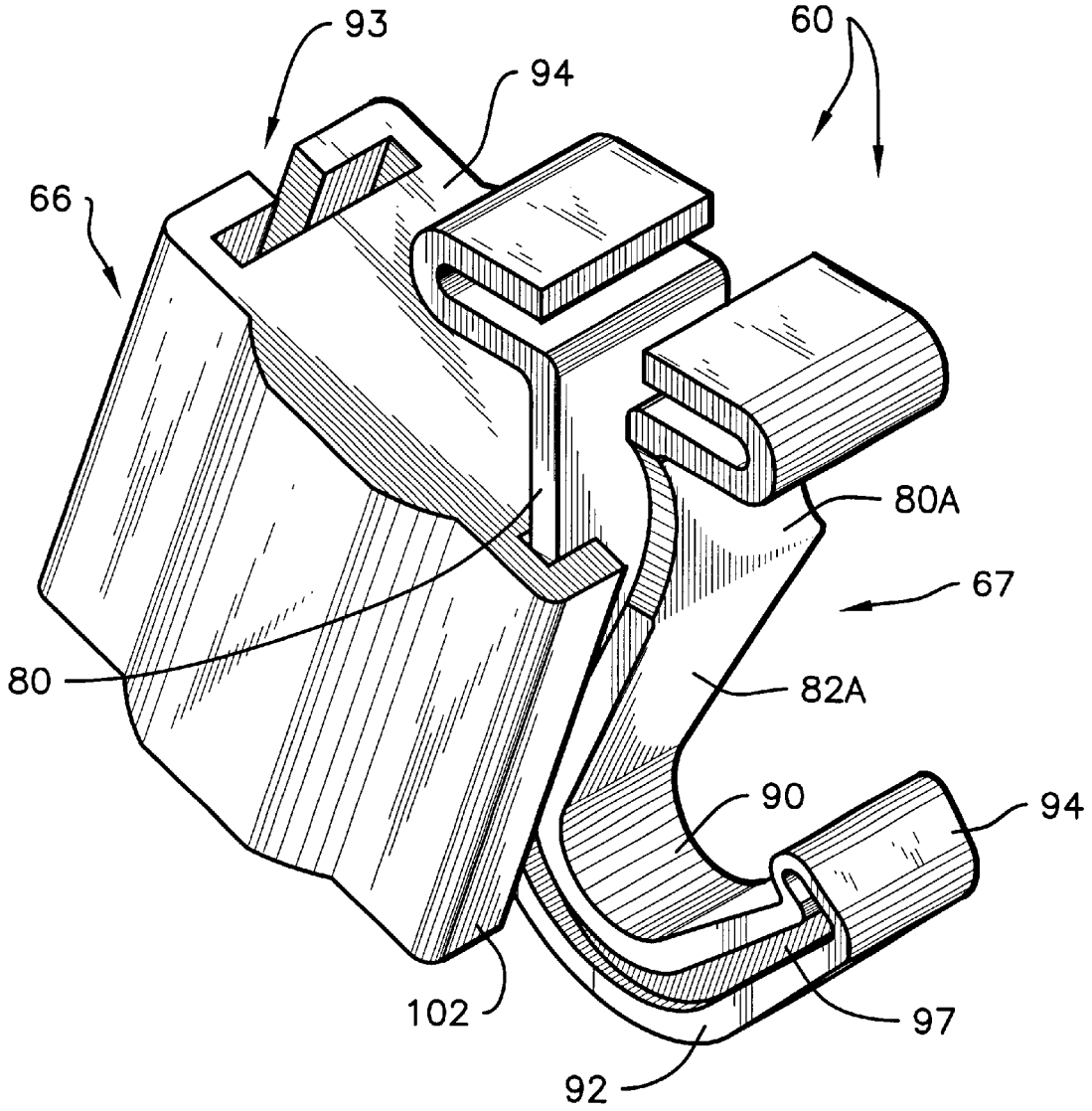
FIG. 23 is an enlarged isometric view of the preferred clip coupled to the preferred tool for subsequent installation.

Hook 68 comprises a pair of arcuate, spaced apart walls 90, 92 that are integral with panels 82, 82A respectively. These complimentary curved walls 90, 92 (FIG. 3) meet at a foot 94 forming a retaining end of the arcuate hook 68. At each side of the hook 68 there is a hollow void 97 (i.e., FIGS. 3, 23) between walls 90, 92. Preferably, an interior reinforcement web 96 (FIG. 9) transversely runs between walls 90, 92 to reinforce the clip and especially hook 68. Web 96 extends between foot 94 and the previously discussed transverse web 84 (FIG. 3). The web 84 forms a flexure point for the opposed jaws 70, 72 to be yieldably and temporarily displaced apart.

Figure 24:
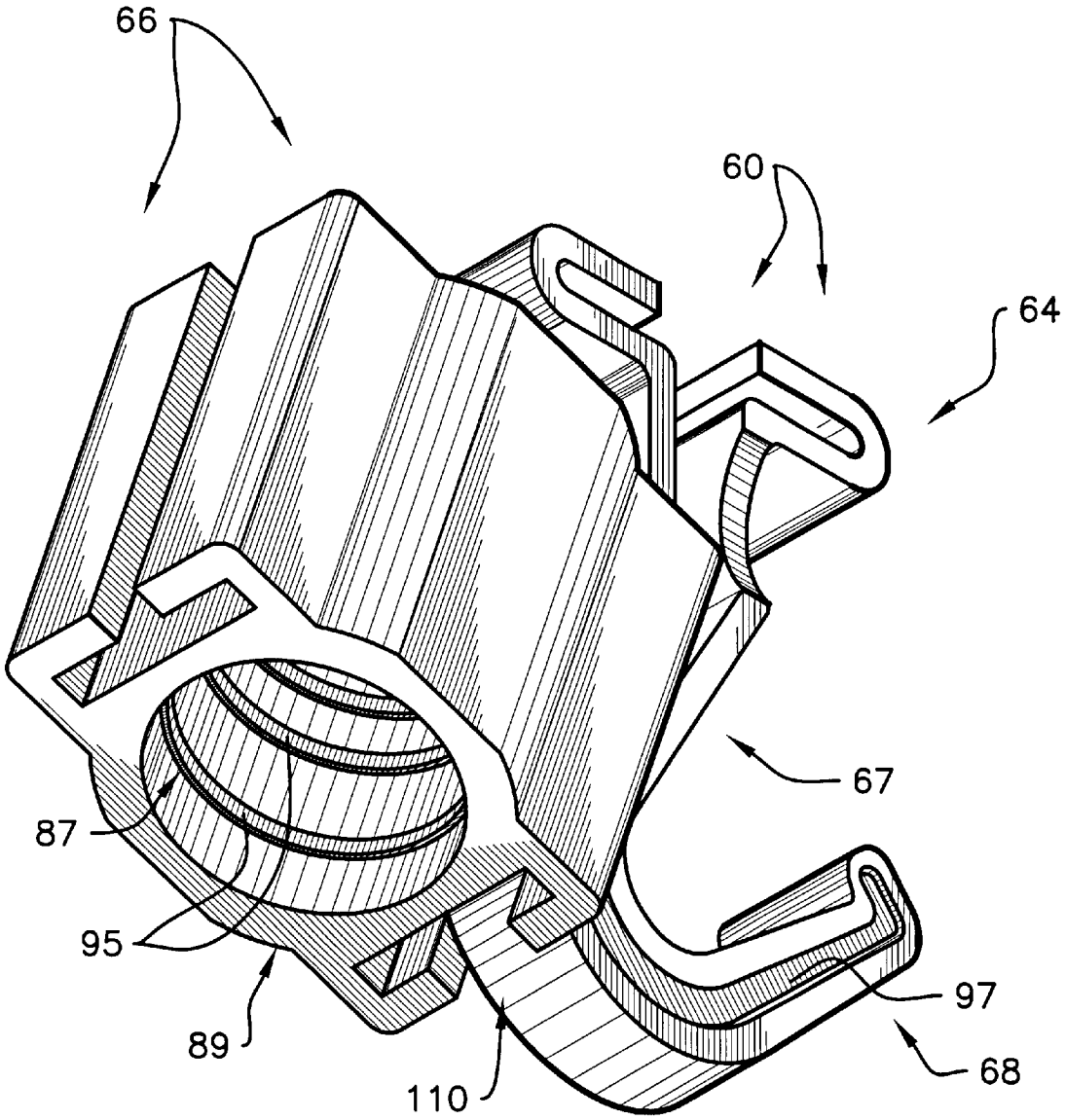
FIG. 24 is an enlarged, bottom isometric view of the preferred clip coupled to the preferred tool that is similar to FIG. 23.
Figure 25:
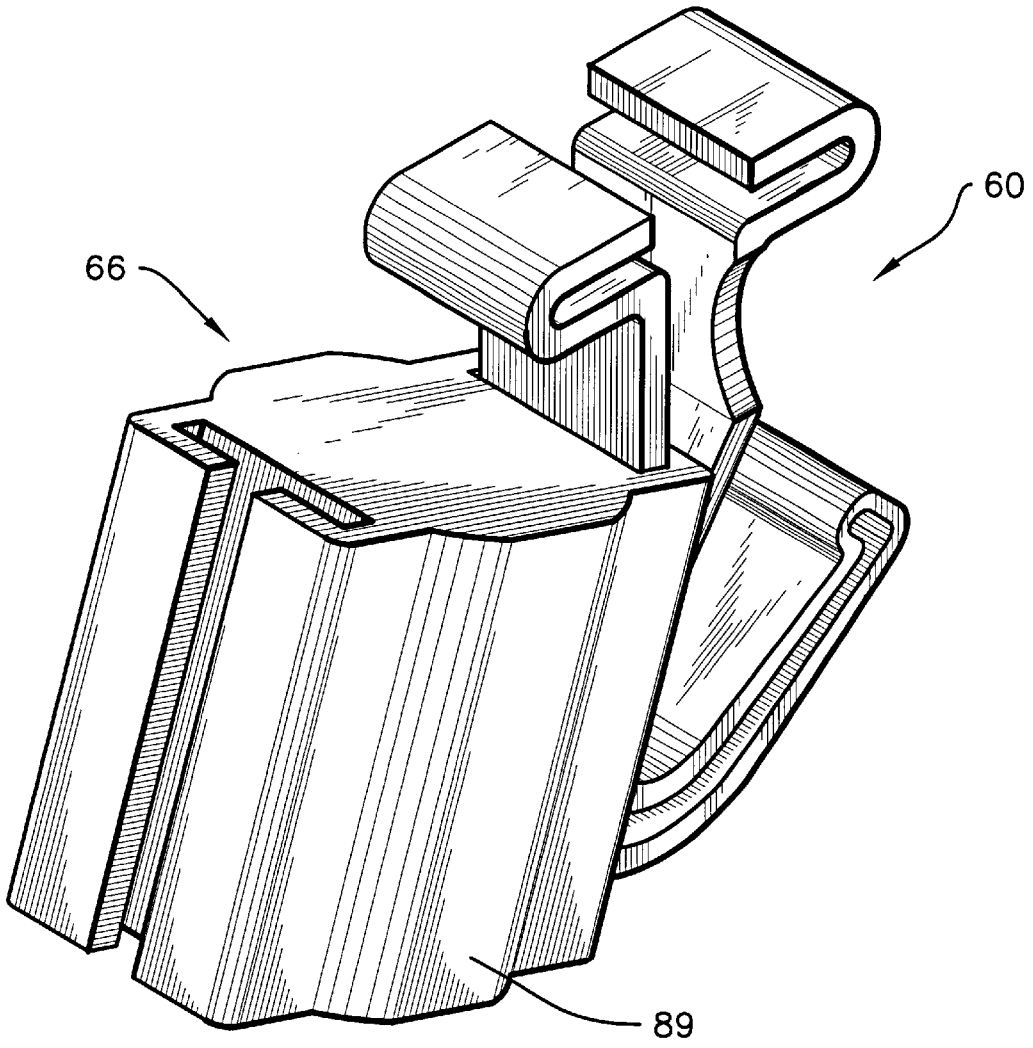
FIG. 25 is an enlarged, rear isometric view of the preferred clip coupled to the preferred tool that is similar to FIGS. 23 and 24.
Figure 26:
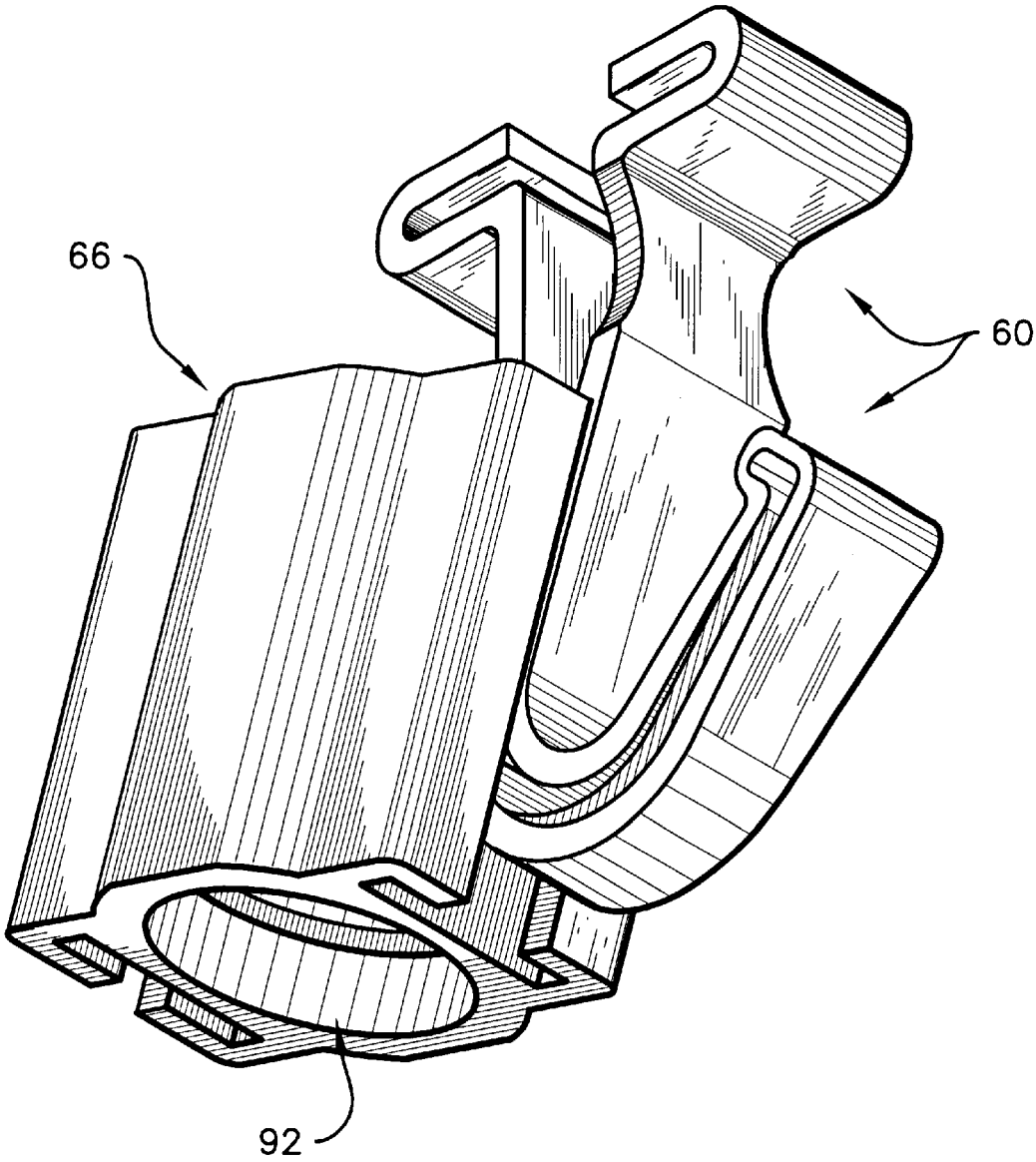
FIG. 26 is an enlarged, frontal isometric view of the preferred clip coupled to the preferred tool that is similar to FIGS. 23–25.

Turning now to FIGS. 10–15, a preferred installation tool 66 is shown in detail. Each tool 66 is preferably injection molded from resilient plastic. The tool comprises a generally cylindrical, barrel-like body 89 whose periphery comprises a pair of opposed, faceted sides 91, 91A and a pair of receptacles 93, 93A (FIGS. 10, 11, 14, 17). The body 89 of tool 66 is preferably provided with a threaded, internal bore 87 (i.e., FIG. 24) that defines a tubular interior. Preferably, ACME threads 95 (FIG. 12) are used, so that bore 87 threadably mates with common household poles 65 (FIG. 1) that are readily available to the user. The top 94 of the barrel tool 66 is closed. Over-tightening of the pole is prevented by an internal, circular ridge lock 98 (FIG. 12) that is spaced apart upwardly within the bore 87 above the threads 95.

Figure 11:
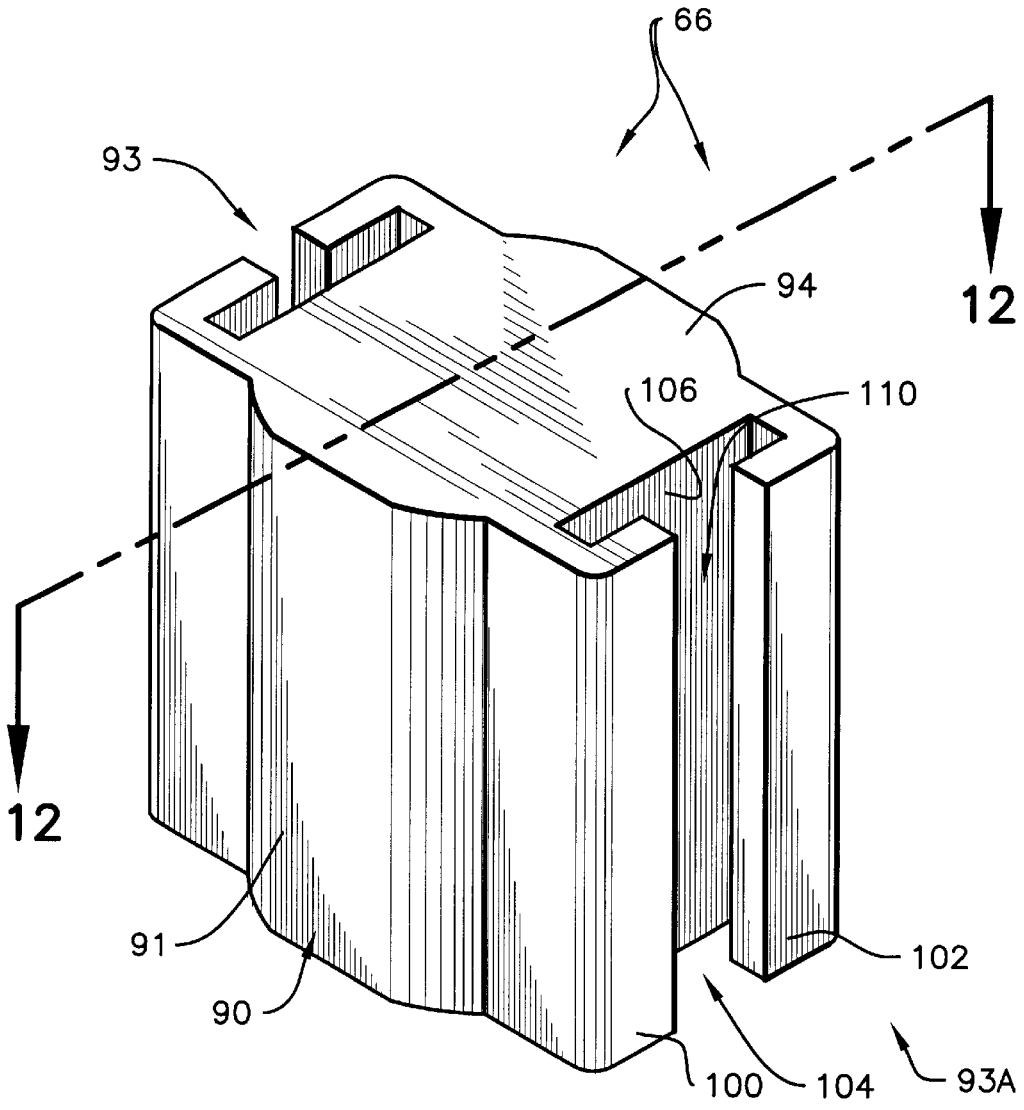
FIG. 11 is an enlarged frontal isometric view of the ceiling clip installer.
Figure 12:
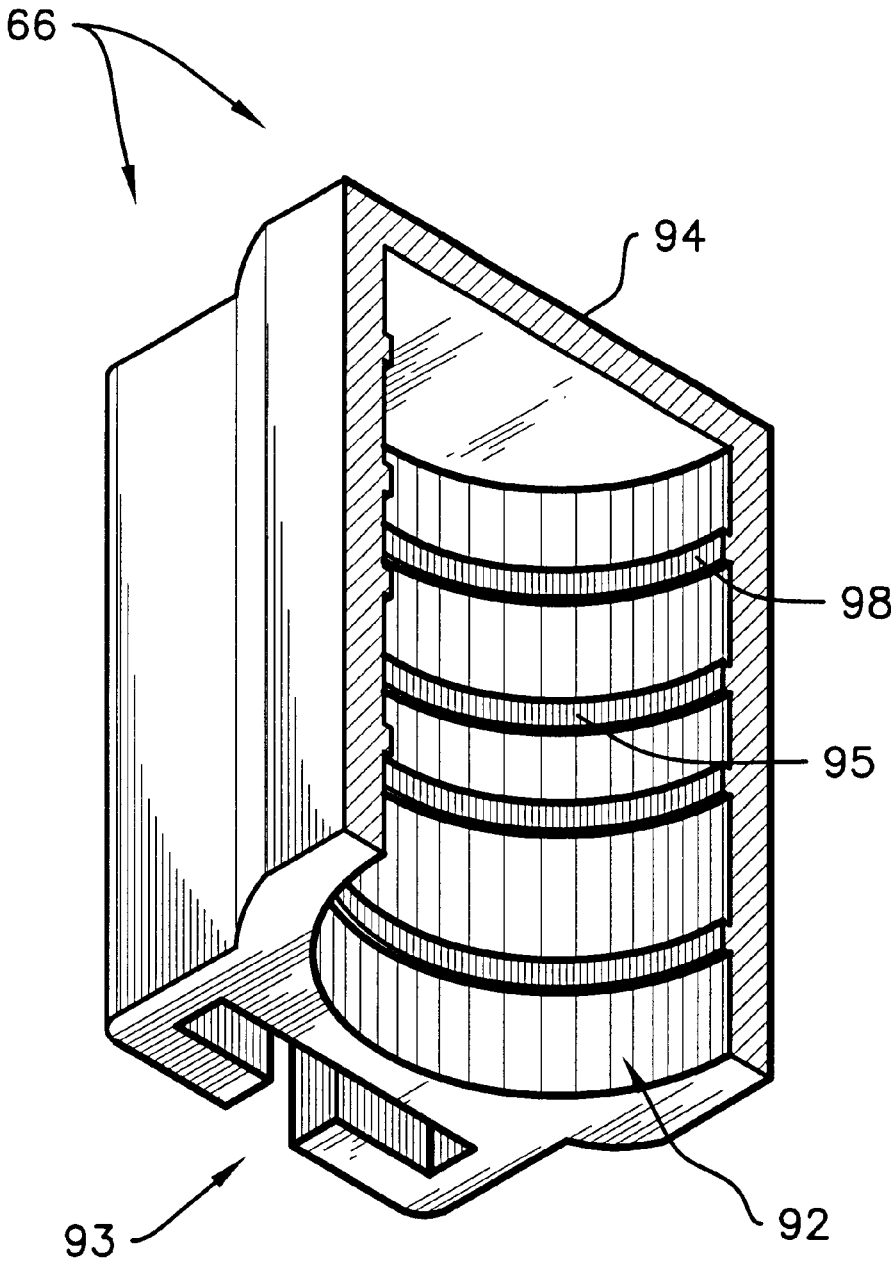
FIG. 12 is a fragmentary sectional view of the preferred installation tool taken generally along line 12—12 of FIG. 11.
Figure 16:
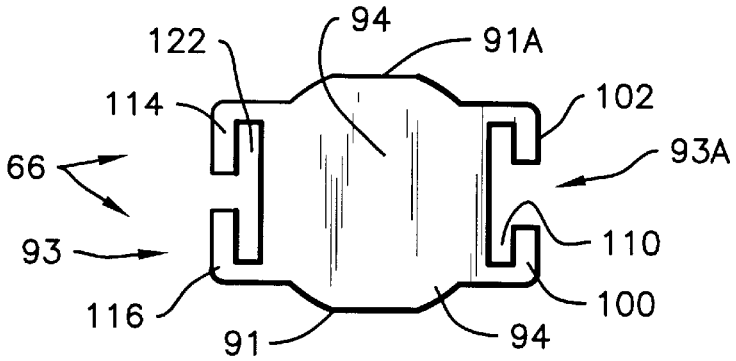
FIG. 16 is a top plan view of the preferred tool taken generally from a position generally above FIG. 13 and looking downwardly.
Figure 14:
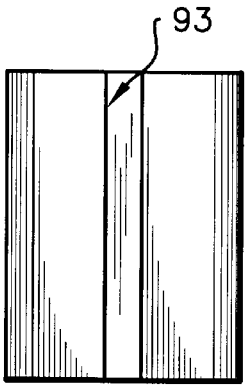
FIG. 14 is a left end view of the preferred tool, taken from a position generally to the left of FIG. 13.
Figure 13:
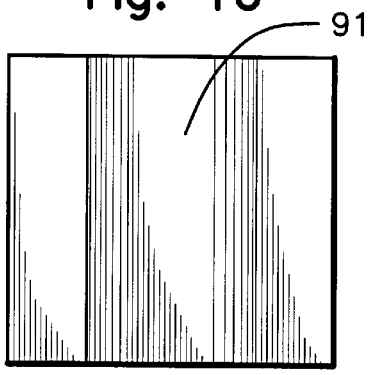
FIG. 13 is a side elevational view of the preferred installation tool.
Figure 17:
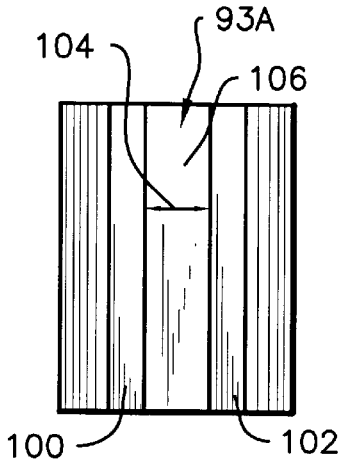
FIG. 17 is a right end view of the preferred tool, taken from a position generally to the right of FIG. 13.
Figure 15:
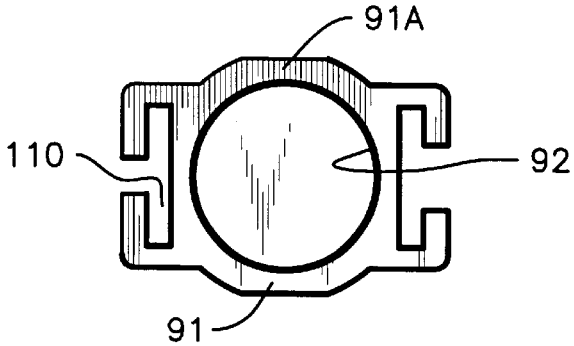
FIG. 15 is a bottom plan view of the preferred tool, taken from a position generally beneath FIG. 13 and looking upwardly.
Figure 21:
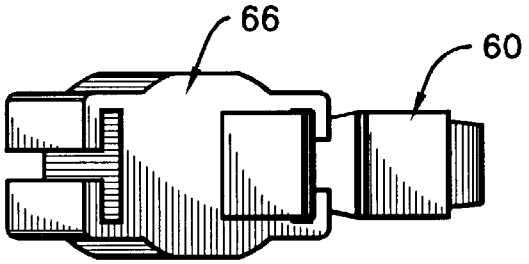
FIG. 21 is a top plan view taken from a position generally above FIG. 18 and looking downwardly.
Figure 19:
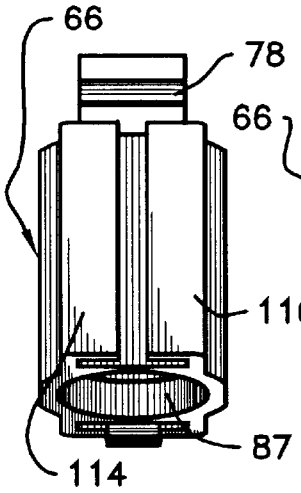
FIG. 19 is a left side elevational view taken from a position generally to the left of FIG. 18.

Importantly, receptacles 93 and 93A (FIGS. 10, 11) function as docking stations for removably and temporarily receiving and controlling the clips 60, 61 to be mounted. These twin, integral receptacles are very similar, but they are dimensioned somewhat differently to fit clips of different sizes and configurations. The receptacle 93A (FIGS. 11, 16, 17) preferably comprises a pair of opposed, generally planar retaining arms 100, 102 that face one another across a central gap 104 (FIG. 17). Each retaining arm 100, 102 is offset from an inner, generally rectangular barrel edge surface 106. An elongated, transverse captivation slot 110 (FIGS. 11, 15, 16) is defined between the arms 100, 102 and the inner edge surface 106 of the barrel tool (FIGS. 11, 15). The captivation slot 110 is generally in the form of a rectangular parallelepiped. Similarly, receptacle 93 (FIG. 10) comprises a pair of opposed, planar arms 114, 116 (FIG. 10) separated by a gap 117. Arms 114, 116 are offset from generally rectangular barrel edge 119. A captivation slot 122 is defined between edge 119 (FIG. 10) and offset arms 114, 116.

Figure 18:
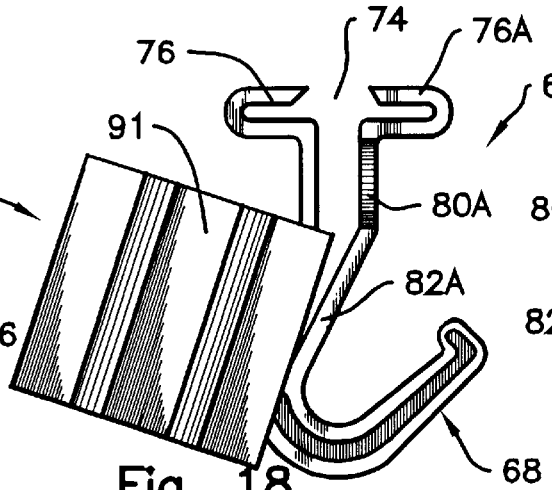
FIG. 18 is a side elevational view of the preferred clip coupled to the preferred tool for subsequent installation.
Figure 20:
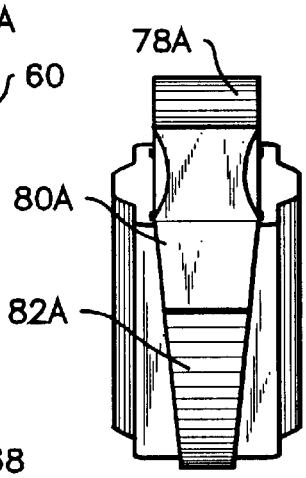
FIG. 20 is a bottom plan view, taken from a position generally beneath FIG. 18 and looking upwardly.
Figure 22:
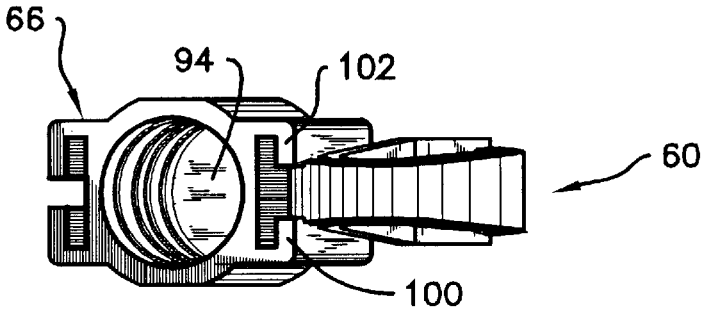
FIG. 22 is a right end view, taken from a position generally to the right of FIG. 18.

With additional reference now directed to FIGS. 18–23, the receptacles 93 and 93A enable the clips 60, 61 to be removably coupled to the barrel tool 66. The clip midportions previously described slidably fit within these captivation slots. The clips are temporarily secured by the arms 100, 102 that engage the midportion sections. Referring again to FIGS. 3 and 5, the intermediate clip panels 80 and 82 are specially dimensioned as aforesaid. The clip 60 may be fitted to the barrel tool 66 by grasping the clip firmly, and placing intermediate panel 82 between gap 104 and into captivation slot 110. By sliding the clip downwardly, the midportion's panel 82 will be positioned within slot 110, with panel 80 positioned just above it (FIG. 18). Thus, the temporarily captivated clip 60 will be firmly grasped by and between the retaining arms 100, 102, which will project into void 74 (FIG. 4) and contact the inner surface 81 (FIG. 4) of panel 80.

To install the clip, an adequate pole 65 (FIG. 1) is coupled to the barrel tool 66. As the pole is threaded (i.e., with ACME threads) it is threadably mated to the threaded barrel tool 66. After a clip 60 to be installed is temporarily, slidably coupled to a receptacle 93 or 93A on the barrel tool 66, the user may elevate the assembly by thrusting the pole 65 upwardly into the immediate proximity of the ceiling rail. The previously described clip jaws will then snap-fit over the horizontal rail bottom section. Afterwards, various diverse items may be easily hung from the hook 68 of the J-shaped clip 60 or 61 (FIG. 1). For example, by way of illustration only, FIG. 1 illustrates a miscellaneous item 57 hung from the ceiling rail. Item 57 is connected via loop or wire 59 to the hook portion of the clip.

Turning now to FIGS. 27–31, an alternative suspended ceiling clip 160 is generally "U"-shaped. The injection molded clip 160 comprises an upper clasp 164, a lower, loop-like hook 169 that can support the item to be suspended, and an integral, intermediate midportion 167 extending between clasp 164 and hook 169. Clip 160 is symmetrical, with each half comprising a mirror image of the opposite half. Unlike the "open" hook 68 of clip 60, hook 169 of clip 160 is "closed" (i.e., FIG. 28).

Figure 28:
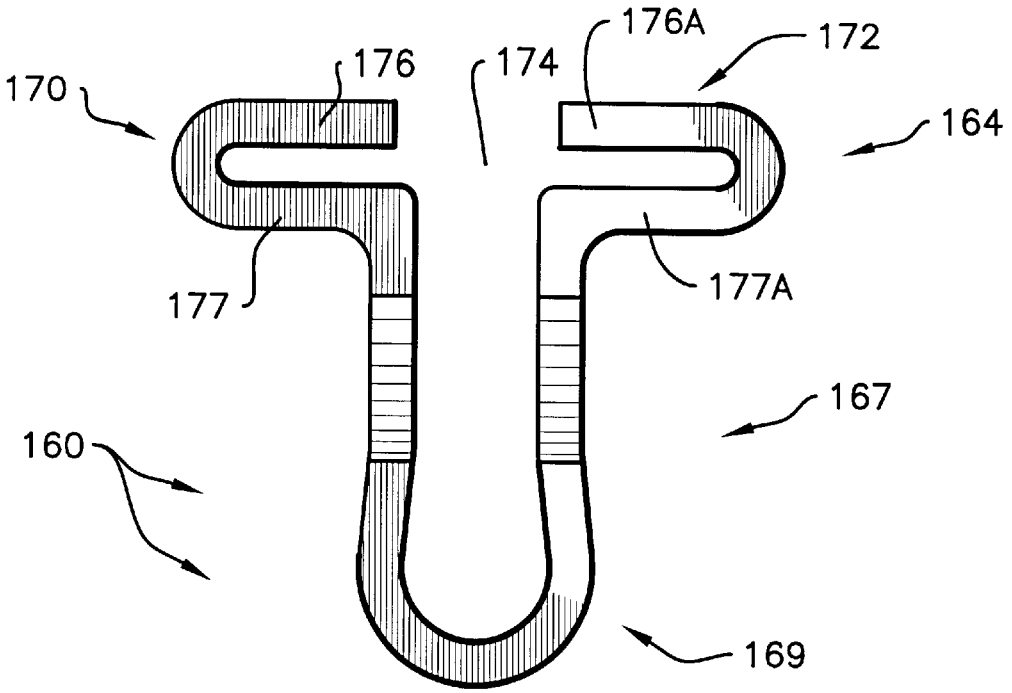
FIG. 28 is an enlarged, side elevational view of an alternative clip.

Upper clasp section 164 comprises opposed jaws 170, 172 that are separated by a gap 174. As before, each jaw 170, 172 is generally C-shaped in cross section. The opposed, upper flanges 176, 176A face each other across gap 174 (FIG. 28). The gripping flanges 176, 176A on the top of each jaw are integral with lower, horizontal projections 177, 177A (FIG. 28). The jaws can be deflected apart and then released to grasp the horizontal rail bottoms 56 (FIG. 1) of the suspended ceiling to mount clips 160. The clip's jaw flanges 176, 176A firmly grasp the rail horizontal bottom 56 (FIG. 1).

The jaws are integral with midportion 167, that is in the form of a trapezoid. An intermediate panel 180 (FIG. 29) is somewhat rectangular, but the lower, adjacent portion 182 decreases in width until it smoothly meets the hook portion 169 at a boundary junction 171. Portion 182 is the same in width as the width 183 (FIG. 29) of the hook 169.

Figure 27:
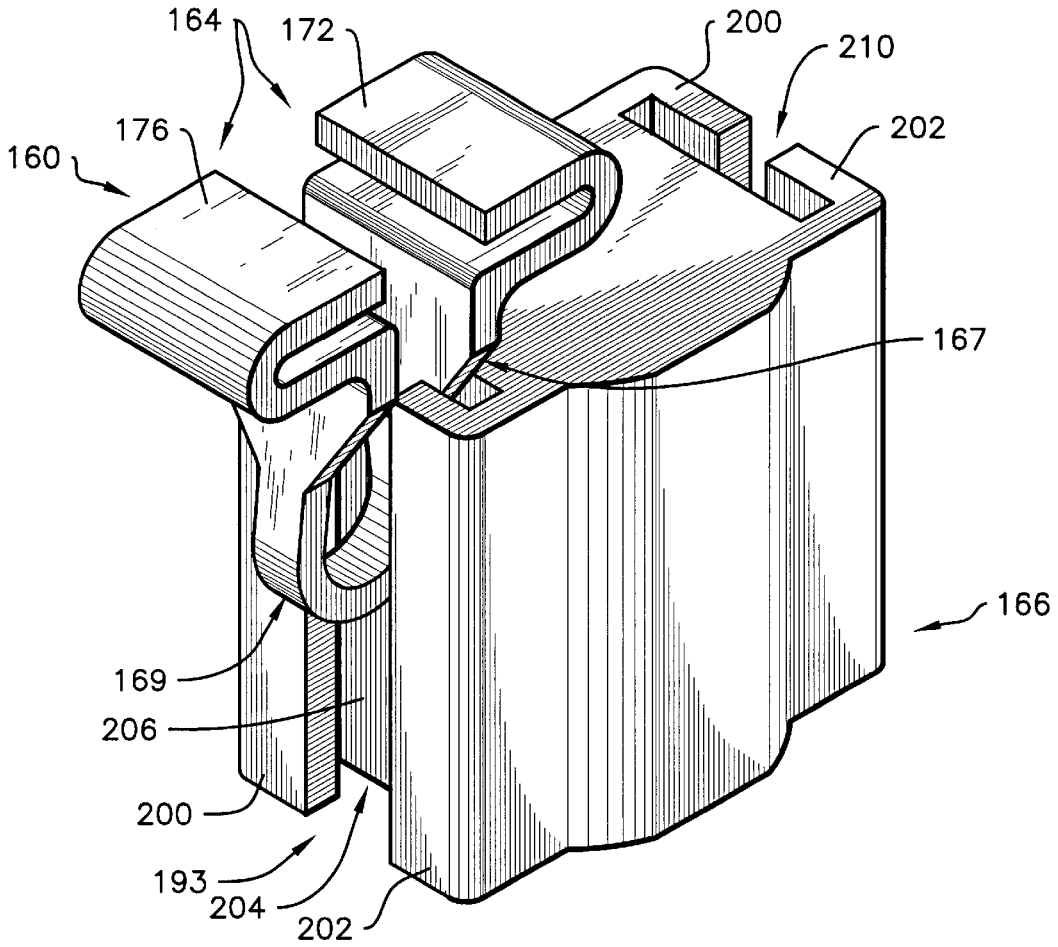
FIG. 27 is an enlarged isometric view of an alternative clip coupled to the preferred tool for subsequent installation.

The preferred installation tool 166 (FIG. 27) is identical to that previously described. As before, receptacles 193 identical with those previously discussed are integrally formed on its body. The tool 166 is threaded as before to receive a threaded mounting pole 65 (FIG. 1). Receptacle 193 (FIG. 27) comprises a pair of opposed, generally planar retaining arms 200, 202 spaced across gap 204 (FIG. 27). The retaining arms 200, 202 are offset from barrel tool edge 206. An elongated, transverse captivation slot 210 is defined between the arms 200, 202 and edge 206.

The U-shaped clip 160 slidably fits to barrel tool 166. Capture occurs as the clip's trapezoidal midportion is fitted within and to the captivation slots 210. When inserted edgewise, integral hook 169 fits neatly within and between barrel tool gap 204. By thereafter sliding the clip downwardly, its trapezoidal midportion 167 mates within captivation slot 210, and the clip is temporarily secured by arms 200, 202 (FIG. 27). Installation proceeds as previously discussed.

Figure 32:
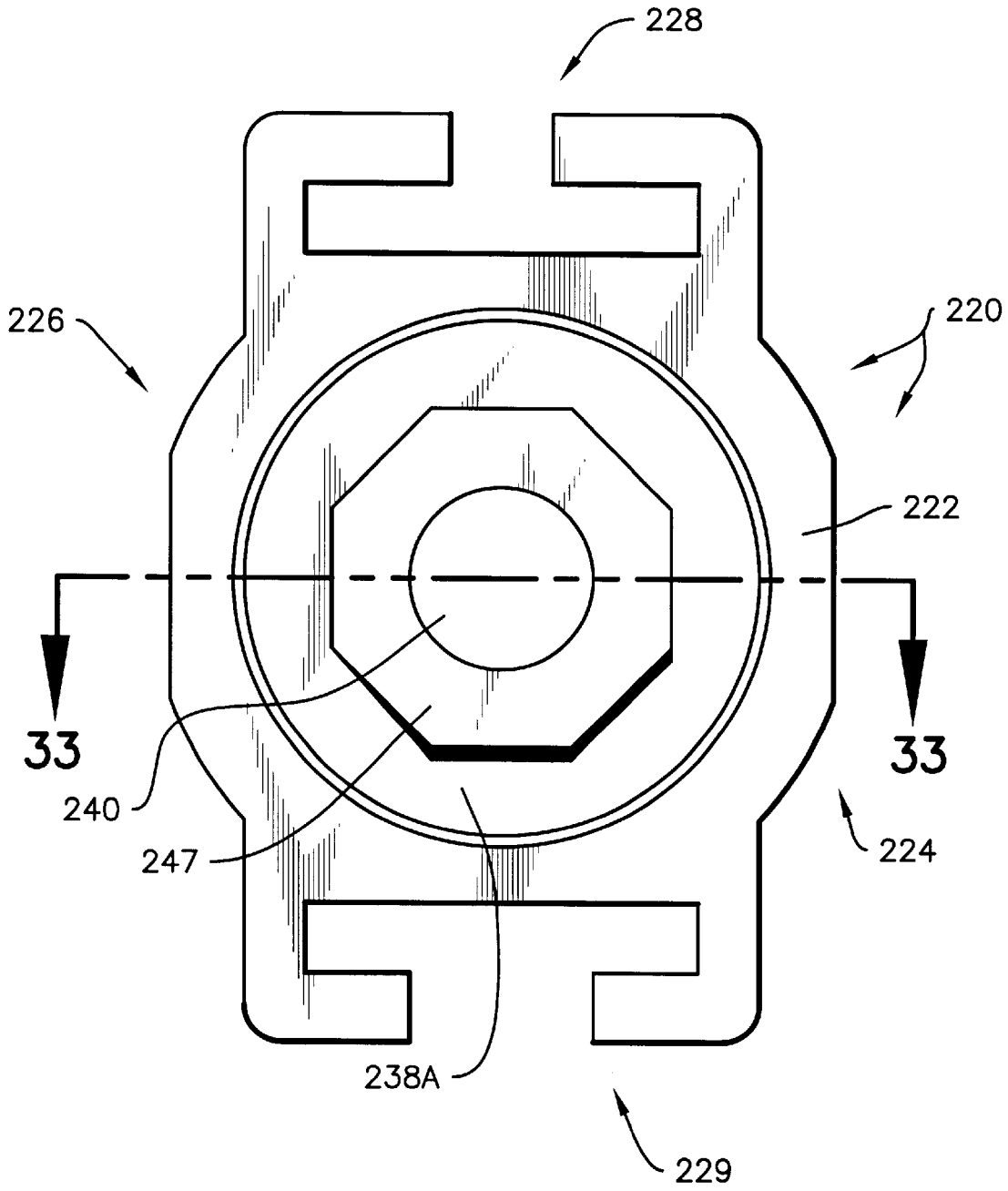
FIG. 32 is an enlarged bottom plan view of an alternative installation tool, showing an optional recess and a through-passage for an optional hex-bolt used to temporality hang items from the barrel; and, FIG. 33 is a fragmentary sectional view taken generally along line 33—33 in FIG. 32.
Figure 33:
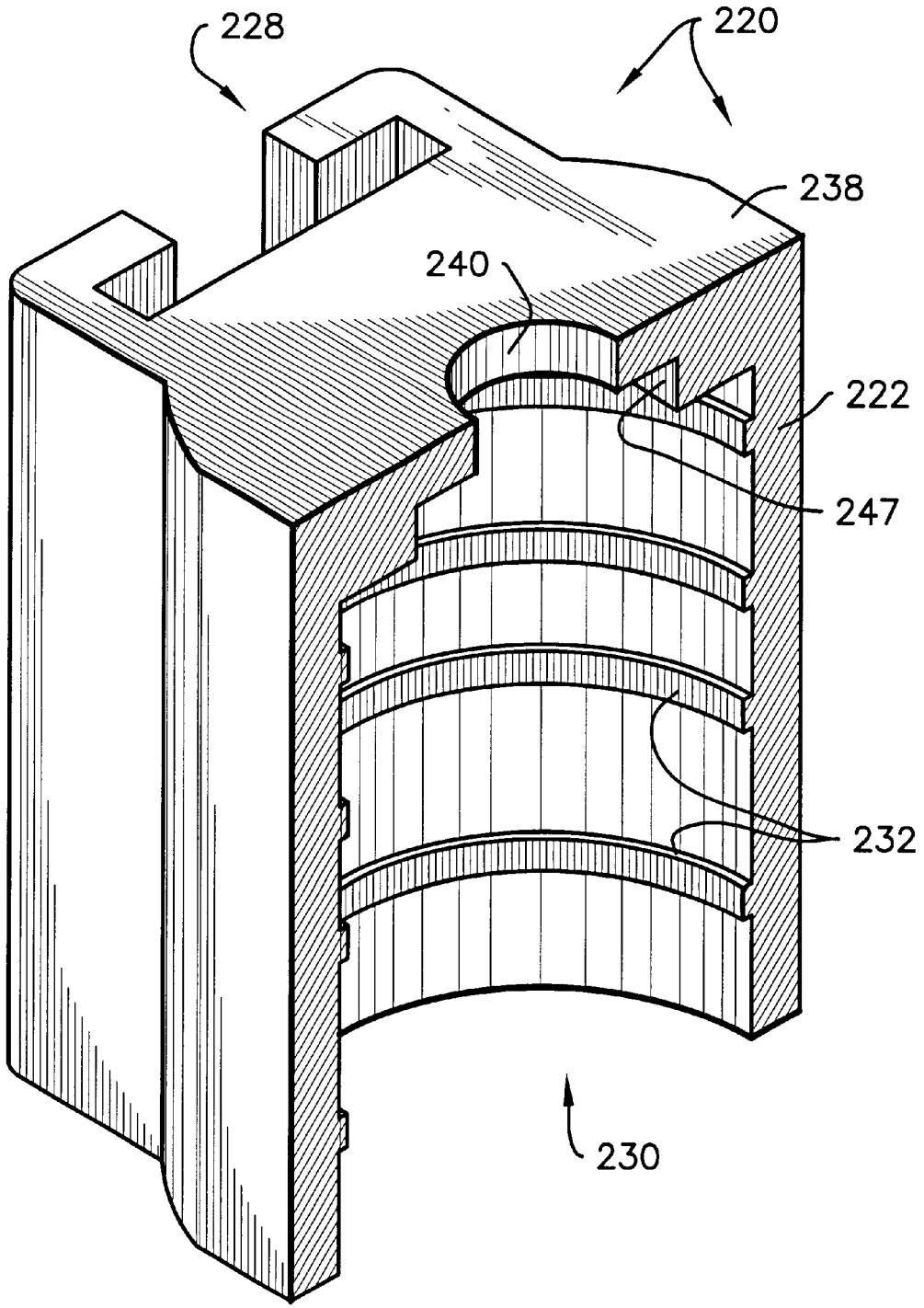

Finally, with reference to FIGS. 32 and 33, a modified installation tool 220 has been shown in detail. Tool 220 comprises a generally cylindrical, barrel-like body 222 having peripheral, faceted sides 224, 226, and a pair of radially spaced apart receptacles 228, 229 similar to those described earlier. Clip midportions are mated to the receptacles as before. The body has an internally-threaded bore 230, preferably equipped with ACME threads 232. Bore 230 threadably receives the installation pole in the manner described earlier. Unlike the closed top 94 previously described, top 238 (FIG. 33) is not completely closed.

Instead, as depicted in FIG. 33, the top 238 has a central orifice 240 defined in it, which is coaxial with the body 222. The orifice 240 is also coaxial with respect to an inner, hexagonal recess 247 (FIG. 32) defined in the underside 238A (FIG. 32) of the installation tool's top 238. An optional hex nut or bolt can be conveniently seated within this hexagonal recess 247. When a hex bolt, for example, is positioned with its head flushly seated within recess 247, it's elongated shank will project out of top 238 through orifice 240, where it will be exposed for rapid interconnection with miscellaneous desired items. For example, once a clip or multiple clips is/are installed, the tool can be lowered for subsequently, temporarily grasping an item to be thereafter suspended from the previously-installed clip. Numerous items to be suspended from the clips as aforesaid can be temporarily supported by suitable conventional hex bolts penetrating orifice 240.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A system for suspending an article from a ceiling rail, the system comprising:

a resilient clip comprising an upper clasp adapted to be coupled to the ceiling rail, a lower hook for supporting the article to be suspended, and an integral, intermediate midportion connecting the clasp and the hook, the midportion comprising a planar portion having a width that gradually decreases towards the hook;

an installation tool adapted to be hand-manipulated by a user for press-fitting the clip onto the desired rail, the tool comprising an elongated, generally cylindrical body comprising receptacle means for temporarily captivating said midportion to control the clip during mounting; and, an elongated pole which can be manipulated from the floor or ground for holding and controlling the tool and the clip held thereby.

2. The system as defined in claim 1 wherein the installation tool and the pole are threadably coupled together.

3. The system as defined in claim 1 wherein each clasp comprises a pair of opposed, deflectable jaws that are each generally C-shaped in cross section, the jaws facing each other across a void and comprising opposed, upper gripping flanges for grasping the rails to secure the clips when they are press fitted to the ceiling rails.

4. The system as defined in claim 1 wherein said receptacle means comprises retaining arms spaced from an edge that define an elongated captivation slot into which the clip slidably fits.

5. The system as defined in claim 1 wherein said clip is generally "J"-shaped.

6. The system as defined in claim 1 wherein said clip is generally "U"-shaped and symmetrical, with a pair of halves comprising mirror images of one another.

7. A system for suspending an article from a ceiling rail, the system comprising a resilient clip comprising an upper clasp adapted to be snap-fitted to a selected ceiling rail, a lower hook for supporting the article to be suspended, and an integral, intermediate midportion connecting the clasp and the hook, the midportion comprising a planar portion having a width that gradually decreases towards the hook;

an installation tool adapted to be manipulated by a user for press-fitting the clip onto the desired rail, the tool comprising sides and receptacle means for temporarily captivating said clip by slidably receiving said clip midportion to enable the handling, mounting and discharge of a clip;

an elongated pole adapted to be removably coupled to said installation tool for remotely manipulating the system; and, wherein each clasp comprises a pair of opposed, deflectable jaws comprising opposed, gripping flanges for grasping the rails to secure the clips when they are press fitted to the ceiling rails.

8. The system as defined in claim 7 wherein the installation tool comprises an apertured top with a recess for seating a bolt to be removably coupled to said installation tool for subsequent suspension from a clip.

9. A method for suspending chosen articles from a conventional suspended ceiling of the type comprising ceiling rails, the method comprising the steps of:

providing a resilient clip comprising opposed, deflectable jaws adapted to snap fit to a ceiling rail, a lower hook, and a midportion between the jaws and the hook;

providing an installation tool comprising receptacle means for temporarily captivating said midportion to handle the clip during mounting;

providing the installation tool with a recess for receiving a fastener for manipulating a subsequent article to be suspended from a clip;

providing said receptacle means with retaining arms spaced from an edge to define an elongated captivation slot into which the clip midportion slidably fits;

removably coupling said clip to said installation tool;

threadably coupling an elongated pole to the installation tool;

manipulating the installation tool and the clip temporarily held thereby with said elongated pole from the floor or ground to position the clip proximate the rail;

pushing the clip towards the rail to snap fit the clip thereto; and, attaching the article to be suspended from said ceiling to the clip's lower hook.

* * * * *